US007899341B2

(12) United States Patent
Moro

(10) Patent No.: US 7,899,341 B2
(45) Date of Patent: Mar. 1, 2011

(54) IMAGE FORMING APPARATUS, ANALYSIS INFORMATION MANAGEMENT METHOD

(75) Inventor: Akihiro Moro, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 733 days.

(21) Appl. No.: 11/865,278

(22) Filed: Oct. 1, 2007

(65) Prior Publication Data

US 2009/0087199 A1 Apr. 2, 2009

(51) Int. Cl.
*G03G 15/00* (2006.01)

(52) U.S. Cl. ..... 399/15; 399/49; 399/60; 399/72; 399/381; 399/397; 399/402; 399/405

(58) Field of Classification Search ..... 399/15, 399/49, 60, 72, 381, 397, 402, 405
See application file for complete search history.

(56) References Cited

U.S. PATENT DOCUMENTS

2005/0207768 A1* 9/2005 Suzuki ..... 399/49

FOREIGN PATENT DOCUMENTS

JP 2006-042002 2/2006

* cited by examiner

*Primary Examiner*—Ryan D Walsh
(74) *Attorney, Agent, or Firm*—Turocy & Watson, LLP

(57) ABSTRACT

A technique that can contribute to improvement of analysis accuracy in analysis processing concerning an image forming apparatus is provided. An image forming apparatus that forms, on a sheet, a test pattern formed by a color obtained by mixing toners of plural colors, scans a test pattern image formed on the sheet with a color sensor, and performs predetermined image quality control processing on the basis of information scanned, the image forming apparatus including an analysis-information forming unit that forms predetermined information used for an analysis concerning the image forming apparatus on a sheet.

19 Claims, 11 Drawing Sheets

IMAGE FORMING APPARATUS, ANALYSIS INFORMATION MANAGEMENT METHOD

BACKGROUND OF THE INVENTION

1. Field of the Invention

The present invention relates to analysis processing concerning an image forming apparatus, and, more particularly to a technique for improving analysis accuracy in the analysis processing.

2. Description of the Related Art

Conventionally, there is known a technique for performing image quality control processing on the basis of an output result of a predetermined test pattern in order to keep image forming characteristics (so-called charging characteristic of a developing agent, gamma characteristic, etc.) in an image forming apparatus in an optimum state.

However, a sheet printed with a test pattern and outputted at the time of the image quality control processing described above is usually discharged to a paper discharge tray same as that for a sheet applied with normal image formation processing. As a result, the sheet having the test pattern printed thereon and the sheet applied with the normal image formation processing are mixed.

Although the sheet having the test pattern printed thereon is an effective determination material in analyzing behaviors of the apparatus under various conditions, the sheet is an unnecessary object for a user of the image forming apparatus after the image quality control processing is completed. Therefore, the sheet having the test pattern printed thereon is disposed of in most cases and cannot be effectively utilized.

SUMMARY OF THE INVENTION

It is an object of an embodiment of the invention to provide a technique that can contribute to improvement of analysis accuracy in analysis processing concerning an image forming apparatus.

In order to solve the problems described above, an image forming apparatus according to an aspect of the invention is an image forming apparatus that forms, on a sheet, a test pattern formed by a color obtained by mixing toners of plural colors, scans a test pattern image formed on the sheet with a color sensor, and performs predetermined image quality control processing on the basis of information scanned. The image forming apparatus is characterized by including an analysis-information forming unit that forms predetermined information used for an analysis concerning the image forming apparatus on a sheet, a sheet conveying unit that conveys the sheet having the predetermined information formed thereon by the analysis-information forming unit to a predetermined position in the image forming apparatus through a second conveying path different from a first conveying path used in discharging a sheet having an image formed thereon to the outside of the image forming apparatus, a sheet storing unit that stores the sheet conveyed to the predetermined position by the sheet conveying unit, and a color sensor that is arranged further on a downstream side than a fixing device in a sheet conveying direction and scans the test pattern formed on the sheet.

An image forming apparatus according to another aspect of the invention is characterized by including an analysis-information forming unit that forms predetermined information used for an analysis concerning the image forming apparatus on a sheet, a sheet conveying unit that conveys the sheet having the predetermined information formed thereon by the analysis-information forming unit, to a predetermined position in the image forming apparatus through a second conveying path different from a first conveying path used in discharging a sheet having an image formed thereon to the outside of the image forming apparatus, and a sheet storing unit that stores the sheet conveyed to the predetermined position by the sheet conveying unit.

An image forming apparatus according to still another aspect of the invention is characterized by including analysis-information forming means for forming predetermined information used for an analysis concerning the image forming apparatus on a sheet, sheet conveying means for conveying the sheet having the predetermined information formed thereon by the analysis-information forming means to a predetermined position in the image forming apparatus through a second conveying path different from a first conveying path used in discharging a sheet having an image formed thereon to the outside of the image forming apparatus, and sheet storing means for storing the sheet conveyed to the predetermined position by the sheet conveying means.

An analysis-information managing method according to still another aspect of the invention is characterized by including an analysis-information forming step of forming predetermined information used for an analysis concerning an image forming apparatus on a sheet, a sheet conveying step of conveying the sheet having the predetermined information formed thereon by the analysis-information forming step to a predetermined position in the image forming apparatus through a second conveying path different from a first conveying path used in discharging a sheet having an image formed thereon to the outside of the image forming apparatus, and a sheet storing step of storing the sheet conveyed to the predetermined position by the sheet conveying step.

DESCRIPTION OF THE EMBODIMENTS

Embodiments of the invention will be hereinafter explained with reference to the drawings.

First Embodiment

Figure 1:
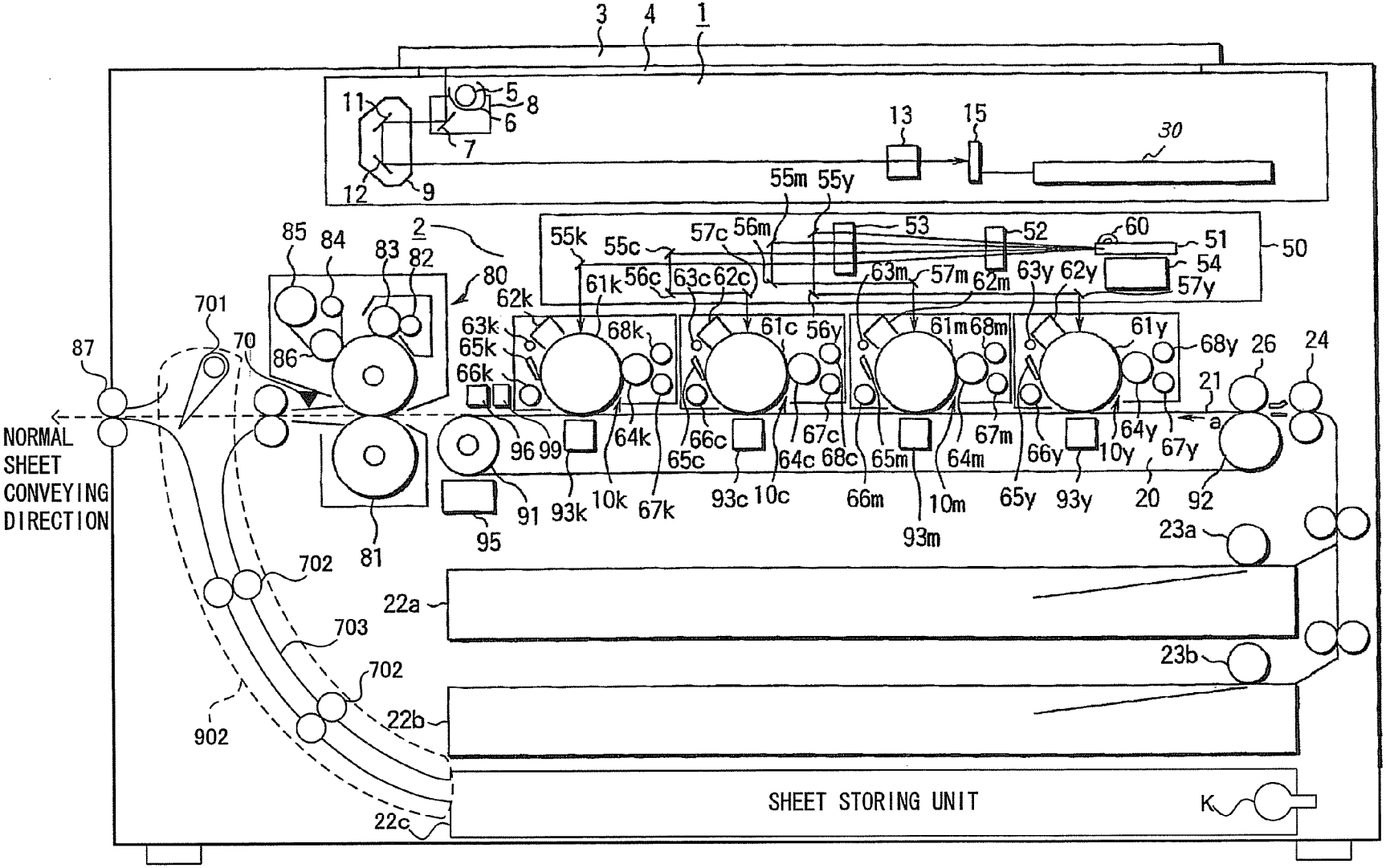
FIG. 1 is a diagram schematically showing an internal structure of an image forming apparatus such as a digital color copying machine that forms a copy image of a color image according to a first embodiment of the invention.

FIG. 1 schematically shows an internal structure of an image forming apparatus such as a digital color copying machine that forms a copy image of a color image according to a first embodiment of the invention. This image forming apparatus is roughly constituted by a color scanner unit 1 as image scanning means for scanning a color image on an original and a color printer unit 2 as image forming means for forming a copy image of the color image scanned.

The color scanner unit 1 has an original stand 4 made of transparent glass that has an original stand cover 3 in an upper part thereof and is disposed to be opposed to the original stand cover 3 in a closed state and on which an original is set. Below the original stand 4, an exposure lamp 5 that lights an original placed on the original stand 4, a reflector 6 for condensing light from the exposure lamp 5 onto the original, a first mirror 7 that bends reflected light from the original in a left direction with respect to the drawing, and the like are disposed. The exposure lamp 5, the reflector 6, and the first mirror 7 are fixed to a first carriage 8. The first carriage 8 is driven by a not-shown pulse motor to be translated along a lower surface of the original stand 4.

On the left side in the figure with respect to the first carriage 8, i.e., in a direction in which light reflected by the first mirror 7 is guided, a second carriage 9 provided to be movable in parallel to the original stand 4 via a not-shown driving mechanism (e.g., a toothed belt and a DC motor) is disposed. In the second carriage 9, a second mirror 11 that bends the reflected light from the original guided by the first mirror 7 downward in the figure and a third mirror 12 that bends the reflected light from the second mirror 11 in the right direction in the figure are arranged at a right angle to each other. The second carriage 9 is driven by the first carriage 8 and translated along the original stand 4 at a speed half of that of the first carriage 8.

In a plane including an optical axis of the light returned by the second and the third mirrors 11 and 12, a focusing lens 13 that focuses the reflected light from the third mirror 12 at a predetermined magnification is arranged. In a plane substantially orthogonal to the optical axis of the light transmitted through the focusing lens 13, a CCD color image sensor (a photoelectric conversion element) 15 that converts the reflected light imparted with a focusing property by the focusing lens 13 into an electric signal is disposed.

When the light from the exposure lamp 5 is condensed onto the original on the original stand 4 by the reflector 6, reflected light from the original is made incident on the color image sensor 15 via the first mirror 7, the second mirror 11, the third mirror 12, and the focusing lens 13. In the color image sensor 15, the incident light is converted into electric signals corresponding to three primary colors of light, i.e., R (red), G (green), and B (blue).

The color printer unit 2 has first to fourth image forming units 10*y*, 10*m*, 10*c*, and 10*k* that form images subjected to color separation for each of color components on the basis of the well-known subtractive color mixture process, i.e., images of four colors of yellow (y), magenta (m), cyan (c), and black (k).

Below the respective image forming units 10*y*, 10*m*, 10*c*, and 10*k*, a conveying mechanism 20 including a conveyor belt 21 as conveying means for conveying the images of the respective colors formed by the respective image forming units in an arrow "a" direction in the figure is disposed. The conveyor belt 21 is wound around and tensed between a driving roller 91 rotated in the arrow "a" direction by a not-shown motor and a driven roller 92 spaced a predetermined distance apart from the driving roller 91. The conveyor belt 21 is caused to endlessly travel in the arrow "a" direction at a constant speed. The respective image forming units 10*y*, 10*m*, 10*c*, and 10*k* are disposed in series along the conveying direction of the conveyor belt 21.

The respective image forming units 10*y*, 10*m*, 10*c*, and 10*k* include photoconductive drums 61*y*, 61*m*, 61*c*, and 61*k* as image bearing members, outer peripheral surfaces of which are formed to be rotatable in an identical direction in positions in contact with the conveyor belt 21, respectively. The respective photoconductive drums 61*y*, 61*m*, 61*c*, and 61*k* are driven at a predetermined speed by a not-shown motor.

The respective photoconductive drums 61*y*, 61*m*, 61*c*, and 61*k* are disposed such that axes thereof are set at equal intervals from one another. The axes are disposed to be orthogonal to the direction in which the images are conveyed by the conveyor belt 21. In the following explanation, an axial direction of the respective photoconductive drums 61*y*, 61*m*, 61*c*, and 61*k* is set as a main scanning direction (a second direction) and a rotating direction of the photoconductive drums 61*y*, 61*m*, 61*c*, and 61*k*, i.e., a rotating direction of the conveyor belt 21 (the arrow "a" direction in the figure) is set as a sub-scanning direction (a first direction).

Around the respective photoconductive drums 61*y*, 61*m*, 61*c*, and 61*k*, charging devices 62*y*, 62*m*, 62*c*, and 62*k* as charging means extended in the main scanning direction, charge removing devices 63*y*, 63*m*, 63*c*, and 63*k*, developing rollers 64*y*, 64*m*, 64*c*, and 64*k* as developing means also extended in the main scanning direction, lower agitating rollers 67*y*, 67*m*, 67*c*, and 67*k*, upper agitating rollers 68*y*, 68*m*, 68*c*, and 68*k*, transferring devices 93*y*, 93*m*, 93*c*, and 93*k* as transferring means also extended in the main scanning direction, cleaning blades 65*y*, 65*m*, 65*c*, and 65*k* also extended in the main scanning direction, and waste-toner collecting screws 66*y*, 66*m*, 66*c*, and 66*k* are arranged in order along the rotating direction of the photoconductive drums 61*y*, 61*m*, 61*c*, and 61*k*, respectively.

The respective transferring devices 93*y*, 93*m*, 93*c*, and 93*k* are disposed in positions for holding the conveyor belt 21 between the transferring devices 93*y*, 93*m*, 93*c*, and 93*k* and the photoconductive drums 61*y*, 61*m*, 61*c*, and 61*k* corresponding thereto, i.e., on the inner side of the conveyor belt 21. Exposure points formed by an exposing device 50 described later are formed on the outer peripheral surfaces of the photoconductive drums 61*y*, 61*m*, 61*c*, and 61*k* between the charging devices 62*y*, 62*m*, 62*c*, and 62*k* and the developing rollers 64*y*, 64*m*, 64*c*, and 64*k*, respectively.

Below the conveying mechanism 20, sheet feeding cassettes 22*a* and 22*b* that store plural sheets P as image forming media, onto which images formed by the respective image forming units 10*y*, 10*m*, 10*c*, and 10*k* are transferred, are arranged.

At one end of the sheet feeding cassettes 22*a* and 22*b* and on a side close to the driven roller 92, pickup rollers 23*a* and 23*b* that take out the sheets P stored in the sheet feeding cassettes 22*a* and 22*b* from the top thereof one by one are arranged. Between the pickup rollers 23*a* and 23*b* and the driven roller 92, registration rollers 24 for aligning a leading end of the sheet P taken out from the sheet cassette 22*a* or 22*b* and a leading end of a yellow toner image formed on the photoconductive drum 61*y* of the image forming unit 10*y* are arranged.

Toner images formed on the other photoconductive drums 61*y*, 61*m*, and 61*c* are supplied to respective transfer positions to be timed to coincide with conveyance timing of the sheets P conveyed on the conveyor belt 21.

Between the registration rollers 24 and the first image forming unit 10*y* and near the driven roller 92, i.e., substantially on the outer periphery of the driven roller 92 across the transfer belt 21, an attracting roller 26 for giving an electrostatic attracting force to the sheet P conveyed at predetermined timing via the registration rollers 24 is disposed. An axis of the attracting roller 26 and an axis of the driven roller 92 are set to be parallel to each other.

At one end of the conveyor belt 21 and near the driving roller 91, i.e., substantially on the outer periphery of the driving roller 91 across the conveyor belt 21, a positional deviation sensor 96 for detecting a position of an image formed on the conveyor belt 21 is disposed.

The positional deviation sensor 96 is constituted by, for example, a transmission or reflection optical sensor.

On the outer periphery of the driving roller 91 and on the conveyor belt 21 on a downstream side of the positional deviation sensor 96, a conveyor-belt cleaning device 95 for removing a toner adhering on the conveyor belt 21, paper dust of the sheet P, or the like is arranged.

In a direction in which the sheet P conveyed via the conveyor belt 21 is separated from the driving roller 91 and further conveyed, a fixing device 80 that melts a toner image transferred on the sheet P by heating the sheet P to a predetermined temperature and fixes the toner image on the sheet P is disposed. The fixing device 80 is constituted by a heat roller pair 81, oil applying rollers 82 and 83, a web winding roller 84, a web roller 85, and a web pressing roller 86. Further on the downstream side than the fixing device 80 in the sheet conveying direction, a color sensor 70 for optically scanning an image (in particular, a test pattern image described later) formed on a sheet is arranged.

The color sensor 70 is a sensor that is capable of scanning a color obtained by mixing toners of plural colors. The color sensor 70 uses, for example, a light source that emits light of a white color (W) as a light emitting element and includes three or more types of filters of red (R), green (G), blue (B), and the like having different spectral transmittances on a light receiving surface thereof as light receiving elements. The light emitting elements in this context are arranged to make light obliquely incident on a sheet surface on which an image to be detected is formed. The light receiving elements are arranged to receive irregularly reflected light from the sheet surface. The light receiving elements convert the received light into an electric signal and output color signals of RGB.

The color scanner unit 1 (an image scanning unit) is capable of performing image scanning with an amount of information (color information, a resolution, a scannable range, etc.) larger than that of the color sensor 70. The sheet P having the toner image heated and fixed thereon in the fixing device 80 is discharged by a paper discharge roller pair 87.

On the downstream side of the fixing device 80, two conveying path, namely, a normal conveying path for discharging a sheet after toner image fixing to the outside of the apparatus and a second conveying path 703 for conveying the sheet to a sheet storing unit 22*c* described later are provided. A sheet-conveying-path switching unit 701 switches the conveying paths in order to send the sheet to one of these two conveying paths. The sheet sent to the second conveying path 703 is conveyed to the sheet storing unit 22*c* by plural conveying rollers 702.

The exposing device 50 that forms electrostatic latent images subjected to color separation on the outer peripheral surfaces of the photoconductive drums 61*y*, 61*m*, 61*c*, and 61*k*, respectively, has a semiconductor laser oscillator 60 controlled to emit light on the basis of image data (Y, M, C, K) of the respective colors subjected to color separation by an image processing unit 36 described later. On an optical path of the semiconductor laser oscillator 60, a polygon mirror 51 that reflects and scans laser beams and is rotated by a polygon motor 54 and fθ lenses 52 and 53 for correcting a focus of the laser beams reflected via the polygon mirror 51 and focusing the laser beams are provided in order.

Between the fθ lens 53 and the respective photoconductive drums 61*y*, 61*m*, 61*c*, and 61*k*, first return mirrors 55*y*, 55*m*, 55*c*, and 55*k* that bend the laser beams of the respective colors transmitted through the fθ lens 53 to exposure positions of the respective photoconductive drums 61*y*, 61*m*, 61*c*, and 61*k* and second and third return mirrors 56*y*, 56*m*, 56*c*, 57*y*, 57*m*, and 57*c* that further bend the laser beams bent by the first return mirrors 55*y*, 55*m*, and 55*c* are arranged.

The laser beam for black is returned by the first return mirror 55*k* and then guided onto the photoconductive drum 61*k* without being bent by the other mirrors.

Figure 2:
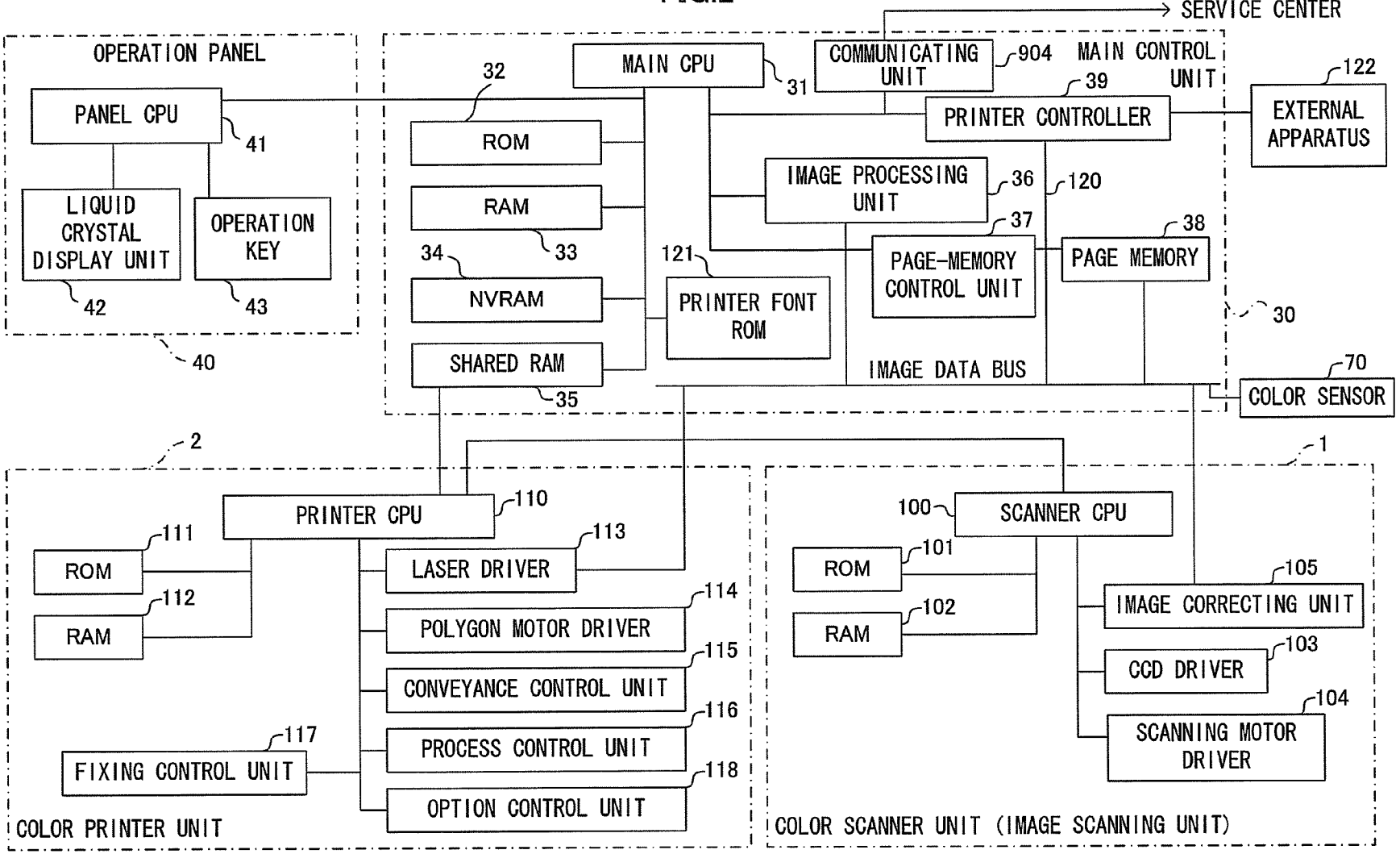
FIG. 2 is a block diagram schematically showing the electrical connection and a flow of a signal for control of the digital copying machine shown in FIG. 1.

FIG. 2 shows a block diagram schematically showing electrical connection and a flow of a signal for control of the digital copying machine shown in FIG. 1. In FIG. 2, a control system is constituted by three CPUs, namely, a main CPU (Central Processing Unit) 31 in a main control unit 30, a scanner CPU 100 of the color scanner unit 1, and a printer CPU 110 of the color printer unit 2.

The main CPU 31 performs bi-directional communication with the printer CPU 110 via a shared RAM (Random Access Memory) 35. The main CPU 31 issues an operation instruction and the printer CPU 110 returns a status. The printer CPU 110 and the scanner CPU 100 perform serial communication. The printer CPU 110 issues an operation instruction and the scanner CPU 100 returns a status.

An operation panel 40 has a liquid crystal display unit 42, various operation keys 43, and a panel CPU 41 connected to the liquid crystal display unit 42 and the operation keys 43. The operation panel 40 is connected to the main CPU 31.

The main control unit 30 is constituted by the main CPU 31, a ROM (Read Only Memory) 32, a RAM 33, an NVRAM 34, a shared RAM 35, an image processing unit 36, a page-memory control unit 37, a page memory 38, a printer controller 39, a printer font ROM 121, and a communicating unit 904.

The main CPU 31 manages overall control. The ROM 32 has a control program and the like stored therein. The RAM 33 temporarily stores data.

The NVRAM (nonvolatile Random Access Memory: nonvolatile RAM) 34 is a nonvolatile memory backed up by a battery (not shown) and holds stored data even if a power supply is isolated.

The shared RAM 35 is used for performing bi-directional communication between the main CPU 31 and the printer CPU 110.

The page-memory control unit 37 stores image information in and reads out the image information from the page memory 38. The page memory 38 has an area that can store image information for plural pages. The page memory 38 is formed to be capable of storing, for each page, data obtained by compressing image information from the color scanner unit 1.

Font data corresponding to print data is stored in the printer font ROM 121. The printer controller 39 expands printer data from an external apparatus 122 such as a personal computer into image data at a resolution corresponding to data indicating a resolution given to the print data using the font data stored in the printer font ROM 121.

The color scanner unit 1 is constituted by the scanner CPU 100 that manages overall control, a ROM 101 having a control program and the like stored therein, a RAM 102 for data storage, a CCD driver 103 that drives the color image sensor 15, a scanning motor driver 104 that controls rotation of a scanning motor for moving the first carriage 8 and the like, an image correcting unit 105, and the like.

The image correcting unit 105 is constituted by an A/D conversion circuit that converts analog signals of R, G, and B outputted from the color image sensor 15 into digital signals, respectively, a shading correction circuit for correcting fluctuation in a threshold level with respect to the output signals from the color image sensor 15 due to variation of the color image sensor 15, ambient temperature change, and the like, a line memory that temporarily stores the digital signals subjected to shading correction from the shading correction circuit, and the like.

The color printer unit 2 is constituted by the printer CPU 110 that manages overall control, a ROM 111 having a control program and the like stored therein, a RAM 112 for data storage, a laser driver 113 that drives the semiconductor laser oscillator 60, a polygon motor driver 114 that drives the polygon motor 54 of the exposing device 50, a conveyance control unit 115 that controls conveyance of the sheet P by the conveying mechanism 20, a process control unit 116 that controls processes for performing charging, development, and transfer using the charging devices, the developing rollers, and the transferring devices, a fixing control unit 117 that controls the fixing device 80, an option control unit 118 that controls options, and the like.

The image processing unit 36, the page memory 38, the printer controller 39, the image correcting unit 105, the laser driver 113, and the color sensor 70 are connected by an image data bus 120.

Figure 3:
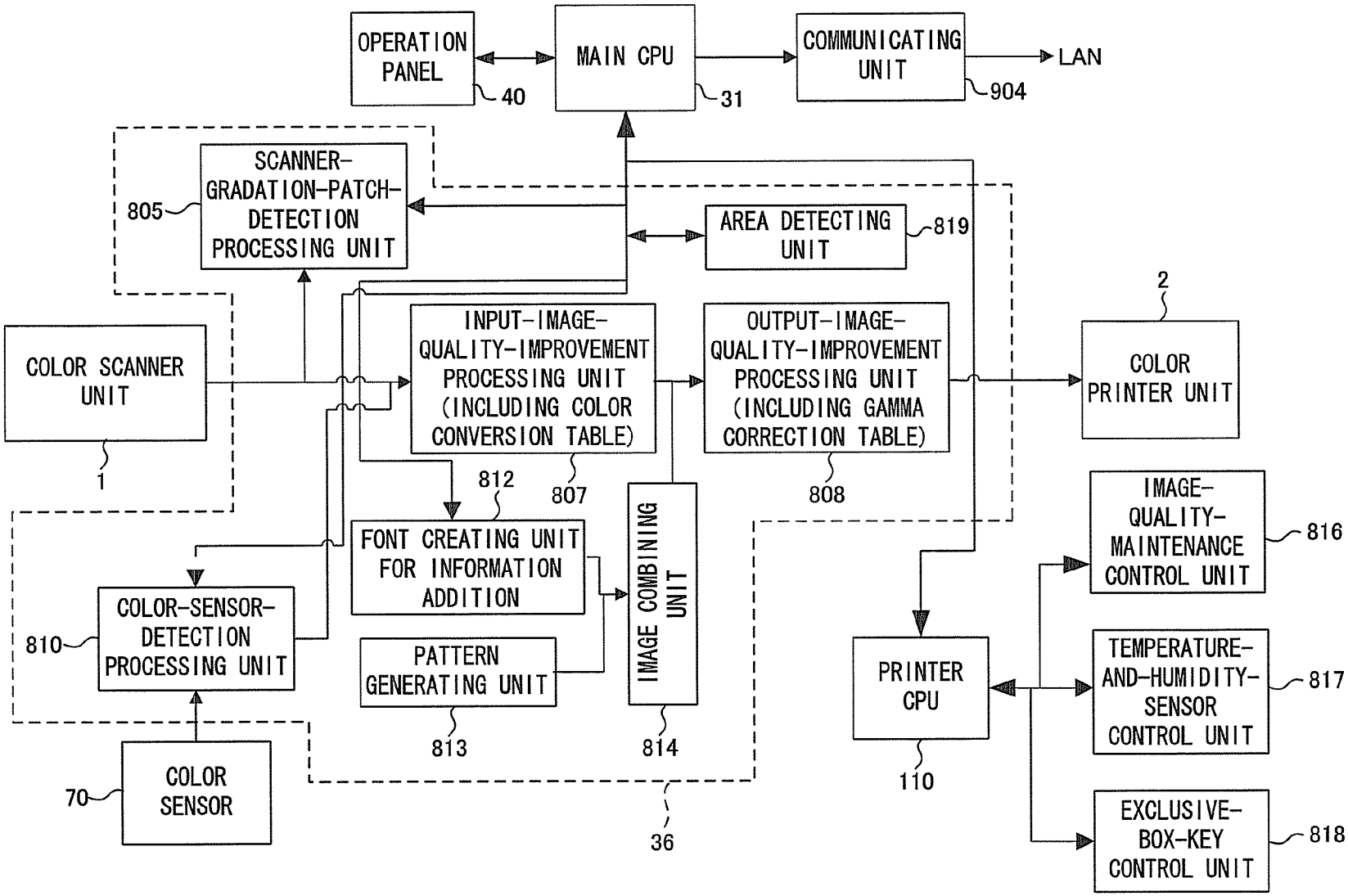
FIG. 3 is a functional block diagram showing details of functions of the image forming apparatus according to the embodiment.

Details of operations in the image forming apparatus according to this embodiment will be explained. FIG. 3 is a functional block diagram showing details of functions of the image forming apparatus according to this embodiment. As shown in the figure, the image forming apparatus according to this embodiment further includes, in addition to the components shown in FIG. 2, a scanner-gradation-patch-detection processing unit 805, an input-image-quality-improvement processing unit 807, an output-image-quality-improvement processing unit 808, a color-sensor-detection processing unit 810, a font creating unit for information addition 812, a pattern generating unit 813, an image combining unit 814, an image-quality-maintenance control unit 816, a temperature-and-humidity-sensor control unit 817, and an exclusive-box-key control unit 818. The image processing unit 36 is constituted by the scanner-gradation-patch-detection processing unit 805, the input-image-quality-improvement processing unit 807, the output-image-quality-improvement processing unit 808, the color-sensor-detection processing unit 810, the font creating unit for information addition 812, the pattern generating unit 813, the image combining unit 814, and an area detecting unit 819.

A test pattern (predetermined information used for an analysis concerning the image forming apparatus) generated by the pattern generating unit 813, identification information for identifying a sheet, and font information and the like (state information concerning a state of the image forming apparatus in forming a test pattern on a sheet) are combined by the image combining unit 814. After executing various kinds of correction processing (including gamma correction processing) by the output-image-quality-improvement processing unit 808, the information is outputted from the color printer unit 2 (an analysis information forming unit). The "state information" in this context includes at least one of temperature, humidity, a detection value, an image formation date, and a counter value detected in the image forming apparatus.

Figure 4:
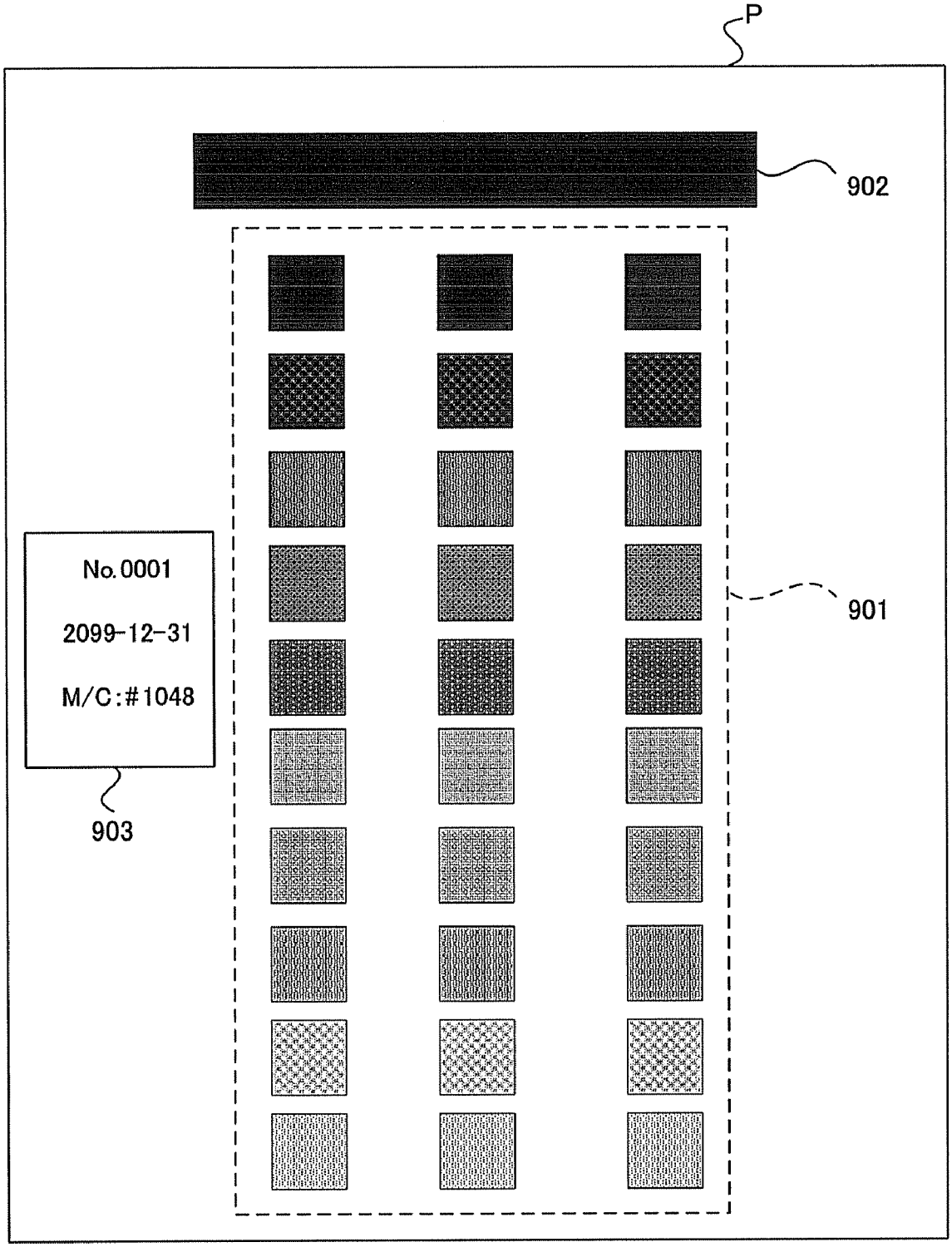
FIG. 4 is a diagram showing examples of a "test pattern", "state information", and "identification information" printed by a color printer unit 2.

FIG. 4 is a diagram showing an example of a "test pattern", "state information", and "identification information" printed by the color printer unit 2. In the example shown in the figure, a gradation pattern 901 used in image quality control processing such as the normal gamma correction processing, a black bar 902 for detecting a position of the gradation pattern 901 on a sheet, and information 903 including "No. 0001" as the identification information, "2099-12-31" that is a test pattern printing date as the state information, and a serial number "M/C: #1048" are printed on the sheet P.

It is unnecessary to form the test pattern only in an area detectable by the color sensor 70. Information useful in performing an analysis on the basis of information on printing on a sheet on which the test pattern is printed may be formed in an area other than the test pattern.

In the figure, an example in which the test pattern, the state information, and the identification information are printed on an identical surface is shown. However, printing of the test pattern is not limited to this. For example, it is also possible to print the test pattern on a first surface of the sheet and print the identification information and the state information on a second surface.

A sheet conveying unit 902 is constituted by the sheet-conveying-path switching unit 701, the plural conveying rollers 702, and the second conveying path 703. The sheet conveying unit 902 conveys the sheet having predetermined information formed thereon by the color printer unit 2 to the inside (a predetermined position) of the sheet storing unit 22*c* in the image forming apparatus through the second conveying path 703 different from the normal sheet conveying path (the first conveying path) used in discharging a sheet having an image formed thereon to the outside of the image forming apparatus.

The sheet storing unit 22 is a box for sheet storage that stores the sheet conveyed to the predetermined position separated from the sheet feeding cassettes 22*a* and 22*b* in which sheets, on which images are formed, are stored. The sheet storing unit 22*c* is locked by a key K that can be unlocked by only a person having a specific authority (e.g., a serviceman) (a mechanism that is not easily accessed by a user). This key K is unlocked by the exclusive-box-key control unit 818 when the serviceman or the like performs authentication processing in the image forming apparatus, uses a key, or inputs a code.

The sheet storing unit 22*c* is provided in a position parallel to the sheets in the sheet feeding cassettes such that sheets of large sizes such as the A3 size can be stored therein. The key K is devised such that the key K cannot be unlocked during job processing.

The communicating unit (a transmitting unit) 904 transmits "at least a part of state information formed on a sheet", "identification information", and "at least a part of information scanned by a color sensor" to a predetermined transmission destination through a telecommunication line such as a LAN or the Internet. By transmitting rough information on a state of the image forming apparatus to a service center or the like in advance in this way, the serviceman or the like can grasp a state of the image forming apparatus as a maintenance object beforehand and can make use of the information for maintenance planning (determination of visit timing, etc.) and image quality management (e.g., an analysis of a color change, an environment density fluctuation amount, detection accuracy, and the like) meeting a user request, and the like.

It is also possible to remotely execute an advanced data analysis and image quality control processing, which cannot be performed in the image forming apparatus, by performing an analysis in the service center or the like on the basis of the data transmitted by the communicating unit 904.

As described above, the image forming apparatus according to this embodiment forms, on a sheet, a test pattern formed by a color obtained by mixing toners of plural colors, scans a test pattern image formed on the sheet with a color sensor, and performs predetermined image quality control processing on the basis of information scanned.

Figure 5:
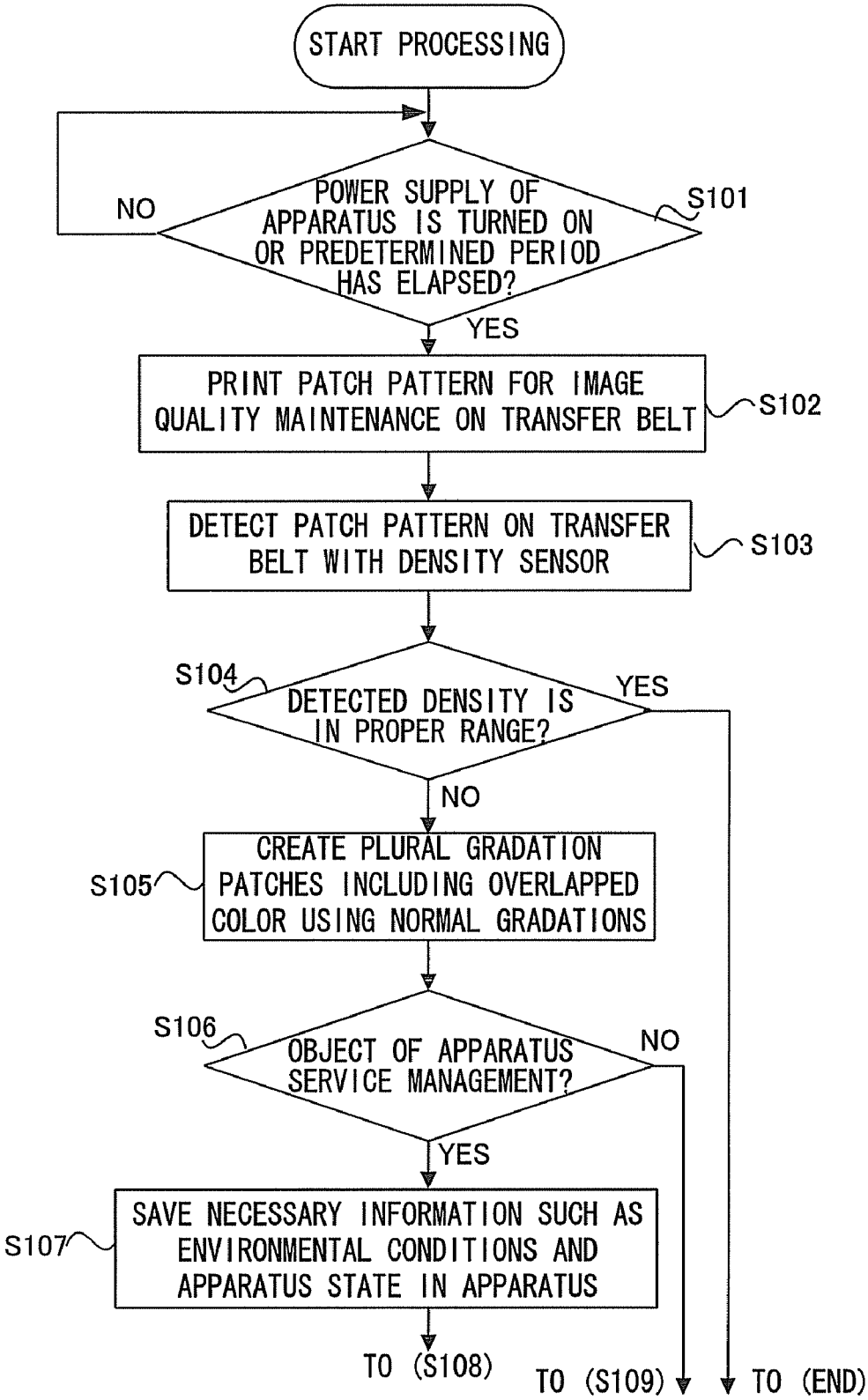
FIG. 5 is a flowchart showing a flow of processing in the image forming apparatus according to the first embodiment of the invention.
Figure 6:
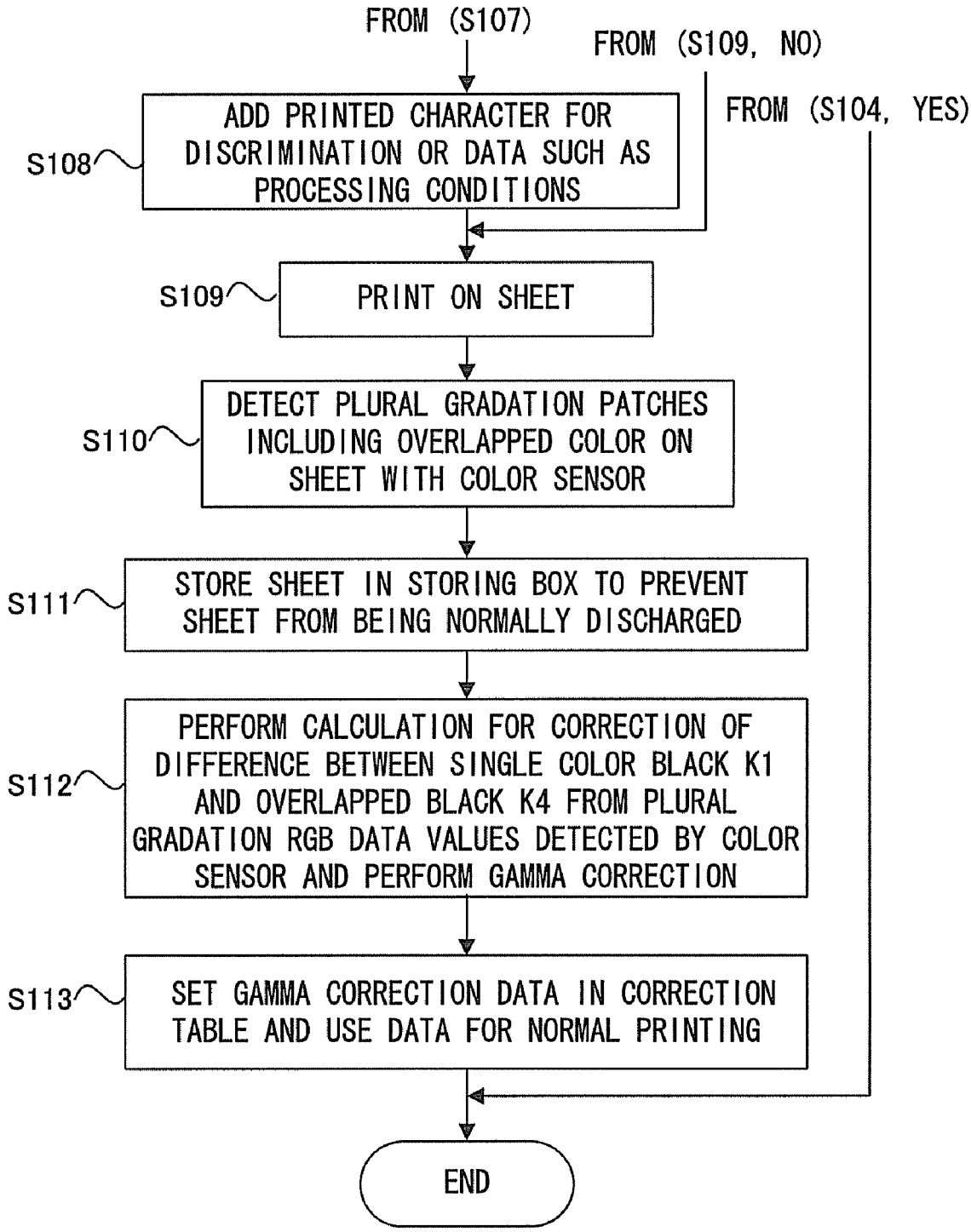
FIG. 6 is a flowchart showing a flow of processing in the image forming apparatus according to the first embodiment of the invention.

FIGS. 5 and 6 are flowcharts showing a flow of processing in the image forming apparatus according to the first embodiment of the invention.

When a power supply of the image forming apparatus is turned on or a predetermined period has elapsed (S101, Yes), a patch pattern for image quality maintenance is printed on a transfer belt (S102). The density of the patch pattern printed on the transfer belt is detected by a density sensor 99 (S103). The density sensor 99 is arranged in, for example, the position shown in FIG. 1 in the sheet conveying direction and near substantially a center position of a belt surface of the conveyor belt 21 in a direction substantially orthogonal to a moving direction of the belt surface.

When the density detected by the density sensor 99 is not in a proper range (S104, No), plural gradation patch images including an overlapped color (a color obtained by mixing toners of plural colors) are created using gradation processing in the number of screen lines used at the time of a normal operation (S105).

When the image forming apparatus is an object of apparatus service management (S106, Yes), information on environmental conditions such as temperature and humidity and information on a state of the apparatus such as a counter value are stored in a memory area in the image forming apparatus (S107). Subsequently, printed characters for discrimination (printed characters for discrimination of a small amount such as numbers of an output order) for identifying a sheet on which the test pattern is printed or data such as processing conditions are added to the test pattern (S108).

The color printer unit 2 prints print data generated as described above on the sheet (S109). Subsequently, an image of the sheet, on which the information generated as described above is printed, is scanned by the color sensor 70 (S110).

The sheet, the image on which is scanned by the color sensor 70, is conveyed to the sheet storing unit 22*c* through the conveying path 703 and stored therein to be prevented from being discharged through the normal conveying path (S111). In the case in which setting indicating that the apparatus service management is valid is made, when the number of sheets stored or the like reaches an upper limit value set in advance, the image forming apparatus automatically notifies the service center or the like of a collection time via the communicating unit 904 by email or the like.

Subsequently, the gamma correction processing in the output-image-quality-improvement processing unit 808 is performed on the basis of the information scanned by the color sensor 70 as described above (S112). Gamma correction data is set in a correction table and reflected on normal image formation processing (S113). At this point, the temperature and the humidity around the density sensor 99 and a counter value and a sensor detection value of the density sensor 99, a detection value of the color sensor, the temperature and the humidity around the color sensor, and a counter value of the color sensor, and the like at the time of execution of image quality maintenance control are saved on the memory in a form in which the information is reduced to necessary information set in advance by the CPU.

Second Embodiment

A second embodiment of the invention will be explained.

This embodiment is a modification of the first embodiment described above. In the following explanation, components already described in the embodiment described above are denoted by the identical reference numerals and signs and explanations of the components are omitted.

In this embodiment, execution timing for gamma correction (timing for printing analysis information such as a test pattern on a sheet) is determined by the main CPU 31 (a timing determining unit) on the basis of information scanned by the color sensor 70.

Specifically, the main CPU 31 monitors, at predetermined timing, image data of an image printed on a sheet at the time of normal image formation. In the case in which it is detected by the area detecting unit 819 that a patch image area or the like printed in a breadth equal to or larger than a predetermined area is included in an image to be printed, when a difference between a density value of a predetermined area in image data (e.g., a part of an area scannable by the color sensor 70 when the image data is formed on the sheet) and a density value at the time when the image data is actually printed on the sheet and scanned by the color sensor 70 is equal to or larger than a predetermined value, the main CPU 31 determines that image quality control processing is necessary and executes printing of a test pattern or the like by the color printer unit 2 (an analysis-image forming unit).

In order to correct deviation of color gradation reproduction by the image quality maintenance control, when a measurement value deviating from a range set in advance is obtained in the density sensor 99, which is provided on the transfer belt and performs image quantity maintenance, the main CPU 31 may cause the color printer unit 2 to execute the printing of a test pattern or the like.

Third Embodiment

A third embodiment of the invention will be explained.

This embodiment is a modification of the first embodiment described above. In the following explanation, components already described in the embodiments described above are denoted by the identical reference numerals and signs and explanations of the components are omitted.

Figure 7:
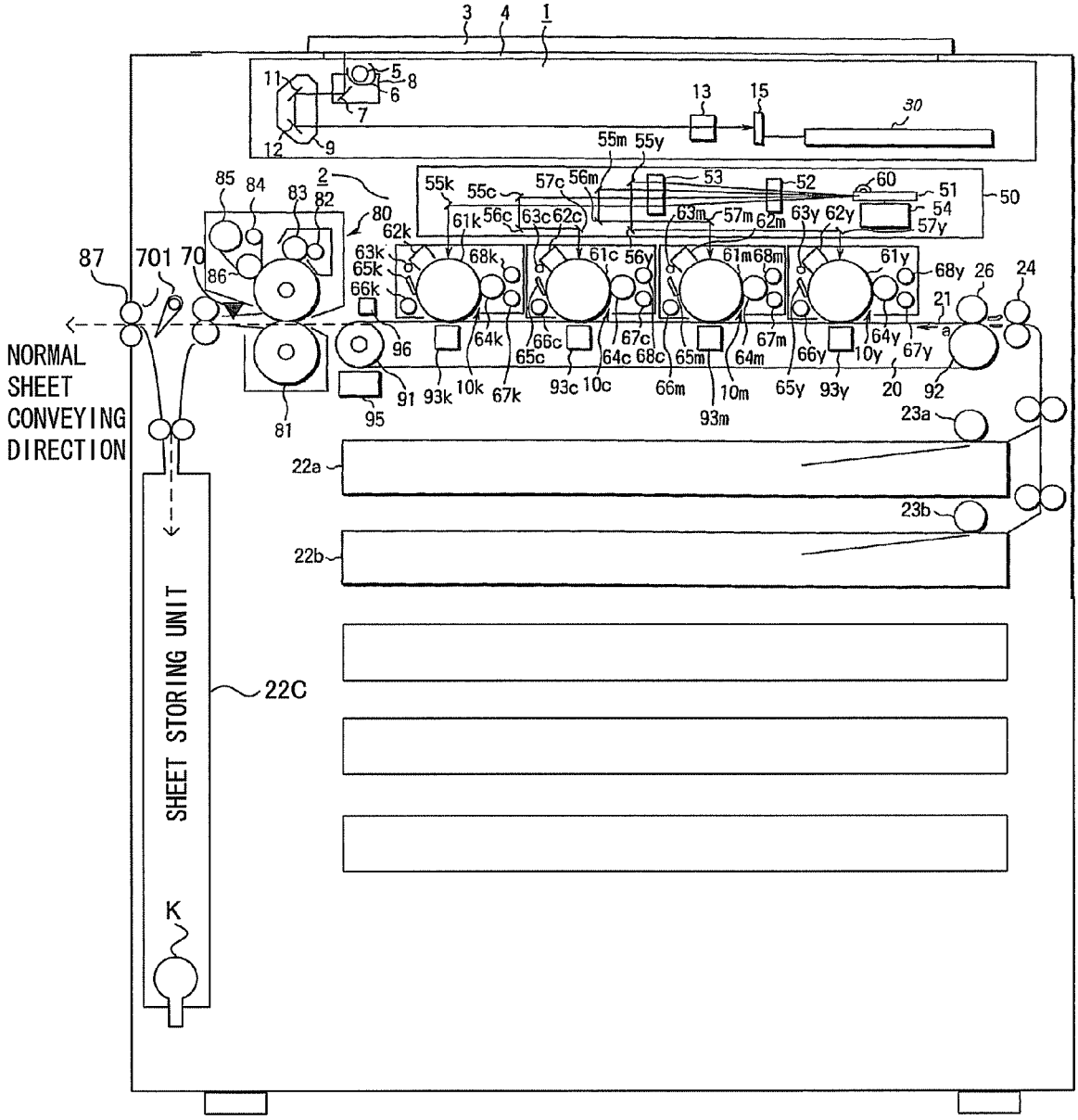
FIG. 7 is a diagram showing a schematic structure of an image forming apparatus according to a third embodiment of the invention.

FIG. 7 is a diagram showing a schematic structure of an image forming apparatus according to a third embodiment of the invention.

In the first embodiment, the sheet storing unit 22*c* is configured to extend in the horizontal direction. However, in this embodiment, the sheet storing unit 22*c* is configured to extend in the vertical direction. Consequently, since the sheet storing unit 22*c* does not affect the number of stages of sheet feeding cassettes or the like in the vertical direction, it is possible to facilitate addition or the like of the sheet feeding cassettes.

Fourth Embodiment

A fourth embodiment of the invention will be explained.

This embodiment is a modification of the first embodiment described above. In the following explanation, components already described in the embodiments described above are denoted by the identical reference numerals and signs and explanations of the components are omitted.

Figure 8:
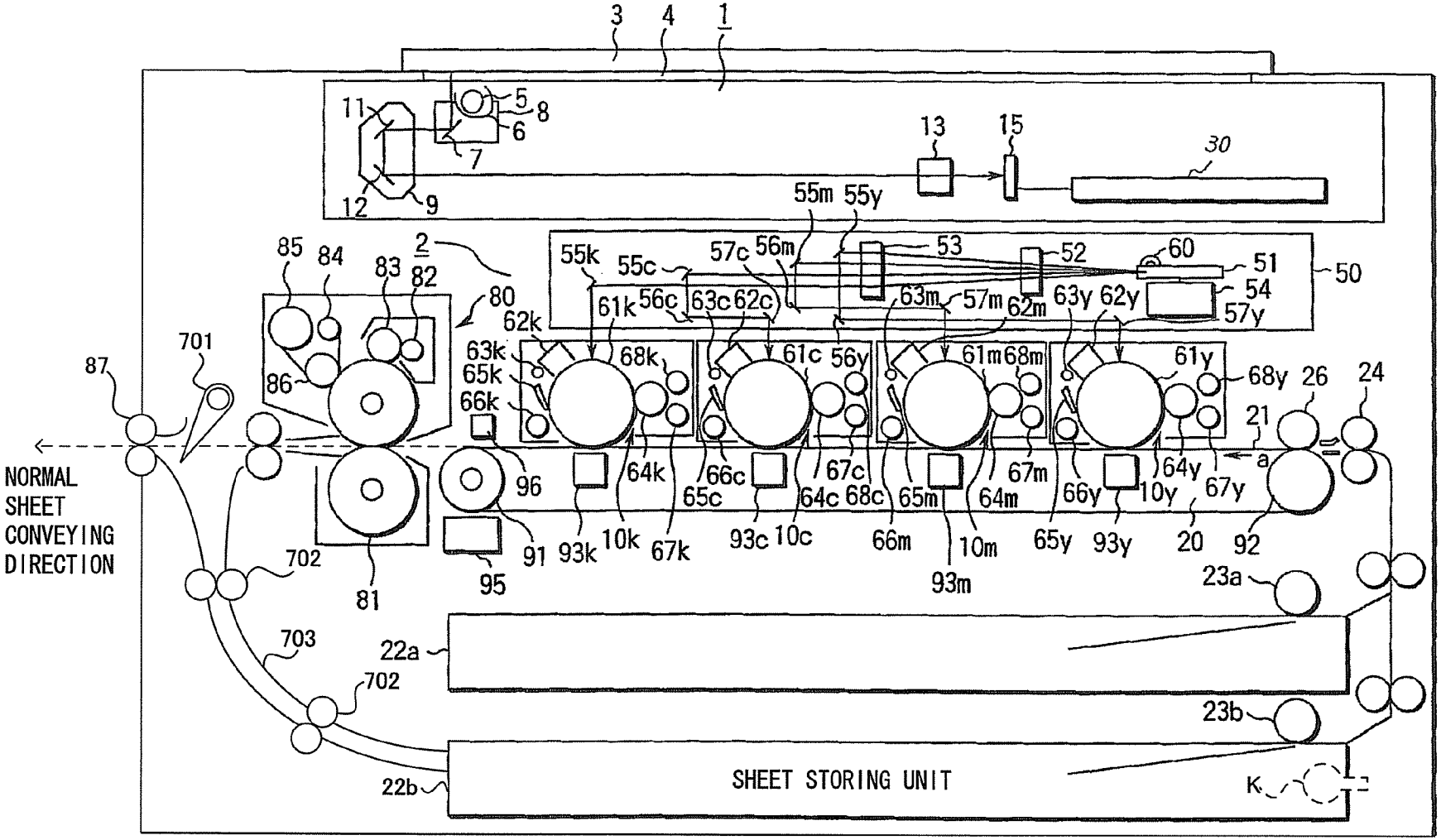
FIG. 8 is a diagram showing a schematic structure of an image forming apparatus according to a fourth embodiment of the invention.

FIG. 8 is a diagram showing a schematic structure of an image forming apparatus according to the fourth embodiment of the invention.

In the first embodiment, the sheet storing unit is configured to be prepared separately from the sheet feeding cassettes. However, in this embodiment, among plural sheet feeding cassettes, for example, a sheet cassette arranged in a position where frequency of use is low is configured to be diverted as a sheet storing unit.

Consequently, it is possible to perform storage of a sheet having analysis information printed thereon without adding anew components or the like for providing a sheet storing unit in the conventional apparatus structure.

Fifth Embodiment

A fifth embodiment of the invention will be explained.

This embodiment is a modification of the first embodiment described above. In the following explanation, components already described in the embodiments described above are denoted by the identical reference numerals and signs and explanations of the components are omitted.

Figure 9:
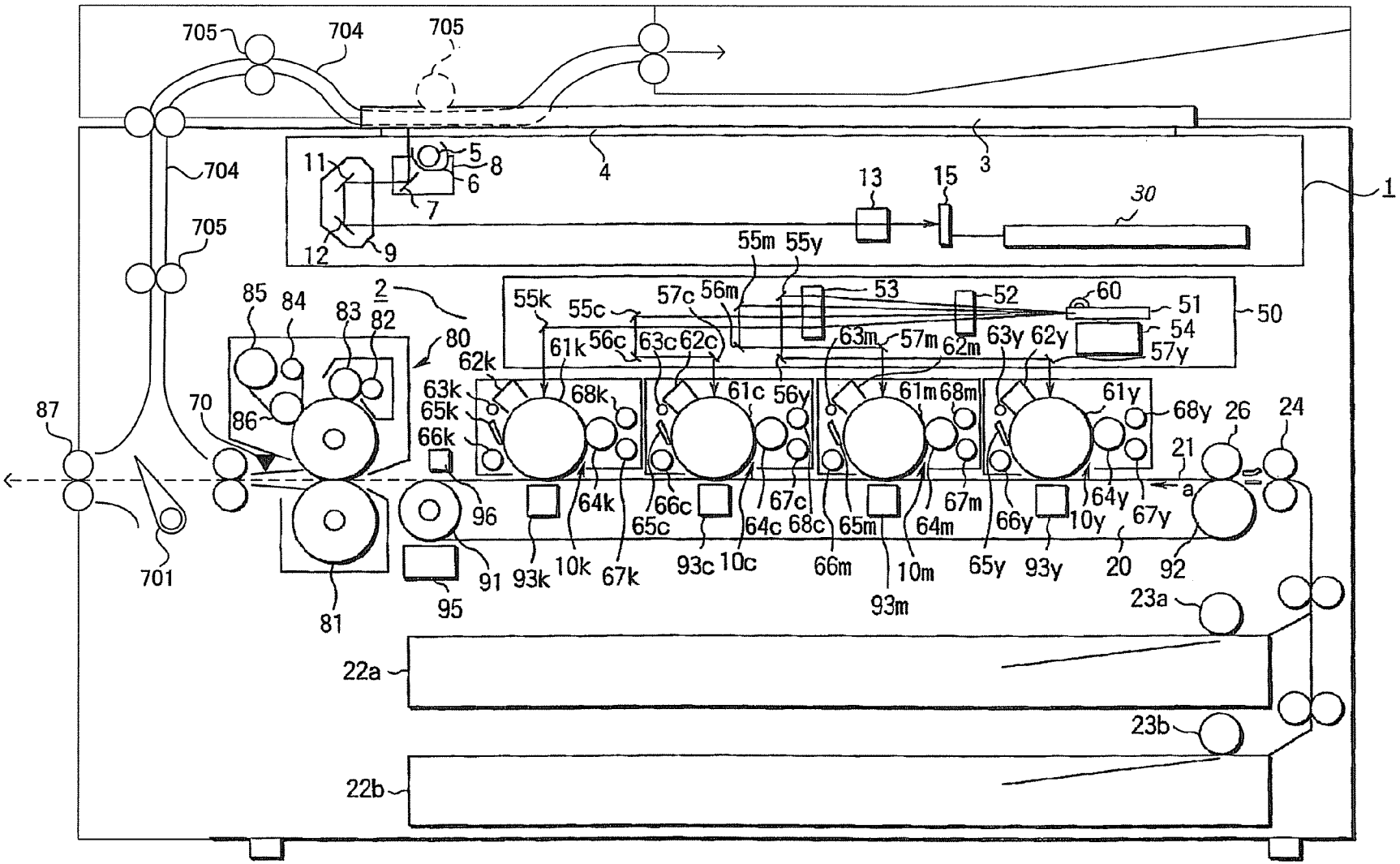
FIG. 9 is a diagram showing a schematic structure of an image forming apparatus according to a fifth embodiment of the invention.

FIG. 9 is a diagram showing a schematic structure of an image forming apparatus according to the fifth embodiment of the invention.

In the respective embodiments described above, a sheet having information for analysis printed thereon is conveyed to a position below the fixing device and stored. However, in this embodiment, the image forming apparatus is configured to convey, with the sheet-conveying-path switching unit 701, a conveying path 704, and a conveying roller 705, a sheet having information for analysis printed thereon to a position where an image is scannable by the color scanner unit 1. In this way, by discharging the sheet having information for analysis printed thereon to a place (e.g., an original paper discharge position in an ADF) different from a place to which a sheet subjected to normal print processing is discharged, it is possible to prevent the sheet having information for analysis printed thereon from being mixed with the normally printed sheet.

Compared with a case in which the information for analysis is scanned using the color sensor 70, since more highly accurate image scanning is possible, it is possible to contribute to improvement of accuracy of image quality control processing such as the gamma correction processing.

By transmitting information obtained by scanning the sheet having information for analysis printed thereon with the color scanner 2 to the service center or the like via the communicating unit in advance, even before the serviceman or the like collects the sheet having information for analysis printed thereon, it is possible to perform analysis processing close to analysis processing performed using the sheet.

Sixth Embodiment

A sixth embodiment of the invention will be explained.

This embodiment is a modification of the first embodiment described above. In the following explanation, components already described in the embodiments described above are denoted by the identical reference numerals and signs and explanations of the components are omitted.

Figure 10:
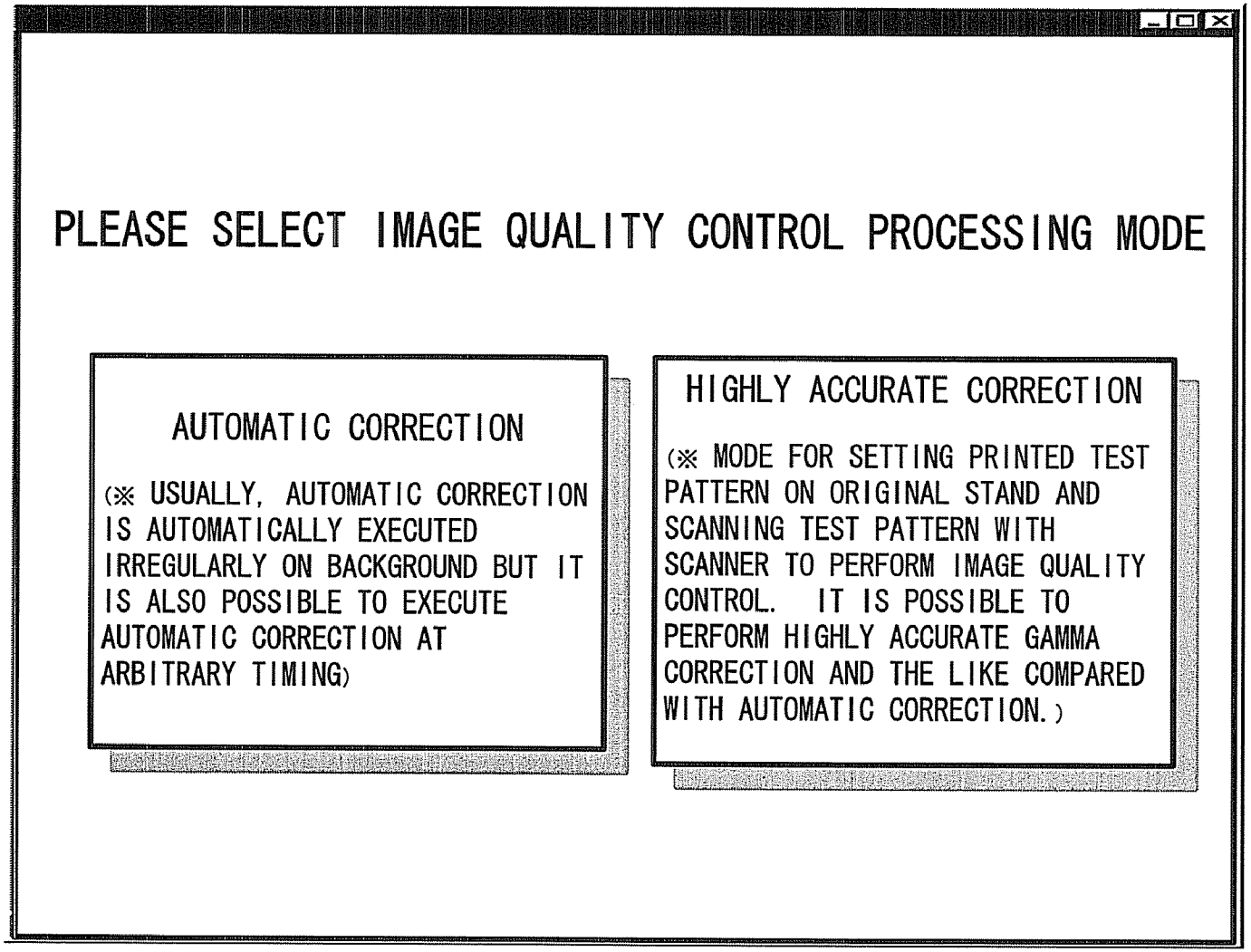
FIG. 10 is a diagram showing an example of a screen for causing a user to select, on an operation panel 40, which of image scanning by a color scanner unit 1 and image scanning by a color sensor 70 is performed.

In this embodiment, a constitution with which a user can select how an image on a sheet having information for analysis printed thereon is scanned (at what scanning accuracy) is described. FIG. 10 is a diagram showing an example of a screen for causing the user to select, on the operation panel 40, which of image scanning by the color scanner unit 1 and image scanning by the color sensor 70 is performed.

When image scanning of a sheet having a test pattern and state information formed thereon performed by using the color scanner unit 1 is instructed to the operation key 43 ("highly accurate correction" is selected), the image forming apparatus scans the test pattern and the like formed on the sheet using the color scanner unit 1. In this case, setting of the sheet on the color scanner unit 1 may be performed according to operation by the user or may be performed by the conveying mechanism shown in FIG. 9.

On the other hand, when image scanning of a sheet having a test pattern and state information formed thereon performed by using the color sensor 70 is instructed to the operation key 43 (""automatic correction" is selected"), the image forming apparatus scans the test pattern formed on the sheet using the color sensor 70. In this case, since processing from printing of information for analysis on the sheet to image quality control processing is automatically performed without causing the user to be aware of the processing, the user is not disturbed.

Consequently, by scanning the test pattern and the like with the image scanning unit capable of performing more advanced image scanning processing than the color sensor instead of the normal automatic image quality control processing based on scanned information in the color sensor, it is possible to cause the image forming apparatus to arbitrarily execute particularly highly accurate image quality control processing. Pattern contents of the test pattern may be varied depending on whether the test pattern is scanned by the color sensor 70 or scanned by the color scanner unit 1.

Figure 11:
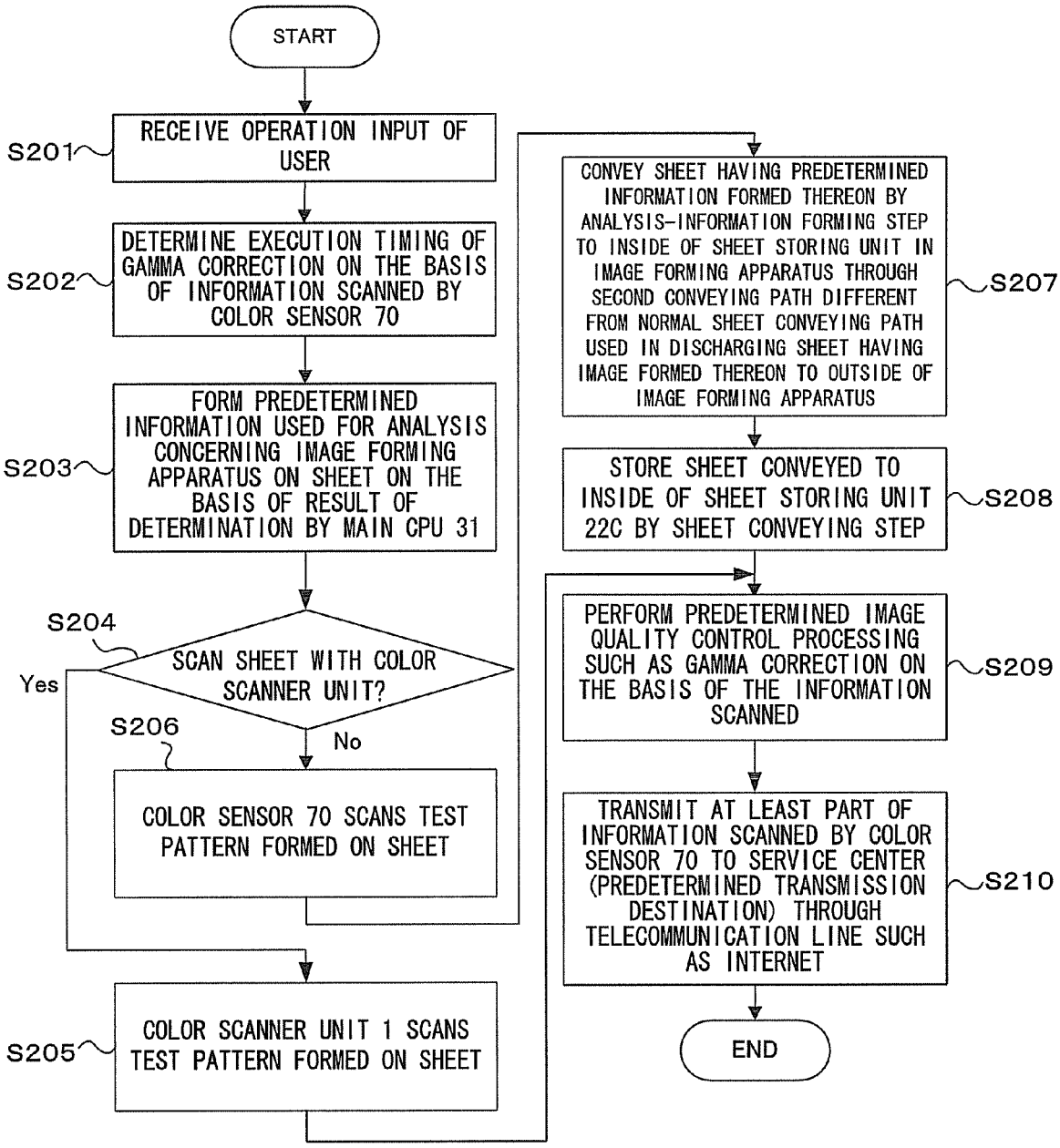
FIG. 11 is a flowchart for explaining a rough flow of processing (an analysis-information managing method) in the image forming apparatus according to an embodiment of the invention.

FIG. 11 is a flowchart for explaining a rough flow of processing (an analysis-information managing method) in the image forming apparatus according to an embodiment of the invention.

The operation key 43 receives operation input by the user (an operation input step) (S201).

The main CPU 31 (the timing determining unit) determines execution timing of gamma correction on the basis of information scanned by the color sensor 70 (S202).

The color printer unit 2 forms predetermined information used for an analysis concerning the image forming apparatus on the sheet on the basis of the determination result by the main CPU 31 (an analysis-information forming step) (S203).

When image scanning of a sheet having a test pattern and state information formed thereon performed by using the color scanner unit 1 is instructed to the operation key 43 (or prior setting for such image scanning is made) (S204, Yes), the color scanner unit 1 scans the test pattern formed on the sheet (an image scanning step) (S205).

On the other hand, when image scanning of a sheet having a test pattern and state information formed thereon performed by using the color sensor 70 is instructed to the operation key 43 (or prior setting for such image scanning is made) (S204, No), the color sensor 70 automatically scans the test pattern formed on the sheet (an image scanning step) (S206).

The sheet having predetermined information formed thereon by the analysis-information forming step is conveyed to the inside of the sheet storing unit 22 (a predetermined position) in the image forming apparatus through the second conveying path 703 different from the normal sheet conveying path (the first conveying path) used in discharging a sheet having an image formed thereon to the outside of the image forming apparatus (a sheet conveying step) (S207).

The sheet storing unit 22*c* stores the sheet conveyed to the inside of the sheet storing unit 22*c* by the sheet conveying step (a sheet storing step) (S208).

The printer CPU 110 (an image-quality control unit) performs predetermined image quality control processing such as gamma correction on the basis of the information scanned (an image quality control step) (S209).

The communicating unit 904 transmits at least a part of the information scanned by the color sensor 70 to a service center (a predetermined transmission destination) through a telecommunication line such as the Internet (a transmitting step) (S210).

The respective steps in the processing (the analysis-information managing method) in the image forming apparatus described above are realized by causing the CPUs (the main CPU 31, the panel CPU 41, the scanner CPU 100, and the printer CPU 110) to execute an analysis-information managing program stored in the memories (the ROM 32, the RAM 33, the ROM 101, the RAM 102, the ROM 111, the RAM 112, the NVRAM 34, and the shared RAM 35).

In the embodiments described above, the example is cited in which the recording medium, on which an image is formed, is a copy sheet or the like. However, the invention is not limited to this. It is possible to adopt any sheet as long as the sheet is a sheet on which it is possible to form an image such as thick paper and an OHP film.

In this embodiment, the functions for carrying out the invention are recorded in the apparatus in advance. However, the invention is not limited to this. The same functions may be downloaded from a network to the apparatus or the same functions stored in a recording medium may be installed in the apparatus. As the recording medium, a form of the recording medium may be any form as long as the recording medium is a recording medium that can store programs and is readable by the apparatus such as a CD-ROM. The functions obtained by installation or download in advance in this way may be realized in cooperation with an OS (Operating System) or the like in the apparatus.

The invention has been explained in detail according to the specific forms. However, it would be obvious for those skilled in the art that various alterations and modifications can be made without departing from the spirit and the scope of the invention.

As described in detail above, according to the invention, it is possible to provide a technique that can contribute to improvement of analysis accuracy in analysis processing concerning the image forming apparatus.

What is claimed is:

1. An image forming apparatus comprising:

an analysis-information forming unit configured to form predetermined information used for an analysis concerning the image forming apparatus on a sheet;

a sheet conveying unit configured to convey the sheet having the predetermined information formed thereon by the analysis-information forming unit, to a predetermined position in the image forming apparatus through a second conveying path different from a first conveying path used in discharging a sheet having an image formed thereon to an outside of the image forming apparatus; and a sheet storing unit configured to store the sheet conveyed to the predetermined position by the sheet conveying unit, wherein the analysis-information forming unit forms, on a sheet, together with a predetermined test pattern used for image quality control processing in the image forming apparatus, state information concerning a state of the image forming apparatus in forming the test pattern on the sheet.

2. An image forming apparatus according to claim 1, wherein the state information is at least one of temperature, humidity, and a counter value detected in the image forming apparatus.

3. An image forming apparatus according to claim 1, wherein the analysis-information forming unit further forms, on a sheet on which the test pattern and the state information are formed, identification information for identifying the sheet, and the image forming apparatus further includes a transmitting unit configured to transmit at least a part of the state information and the identification information formed on the sheet to a predetermined transmission destination.

4. An image forming apparatus according to claim 3, comprising a color sensor that is arranged further on a downstream side than a fixing device in a sheet conveying direction and scans the test pattern formed on the sheet, wherein the transmitting unit transmits at least a part of information scanned by the color sensor to the predetermined transmission destination.

5. An image forming apparatus according to claim 1, wherein the predetermined position in the image forming apparatus is located in a place spaced apart from a sheet feeding cassette in which sheets, on which images are formed, are stored.

6. An image forming apparatus according to claim 1, wherein the sheet storing unit is a sheet feeding cassette in which sheets, on which images are formed, are stored.

7. An image forming apparatus according to claim 1, comprising:

a color sensor that is located further on a downstream side than a fixing device in a sheet conveying direction and scans an image on a sheet conveyed; and a timing determining unit configured to determine timing of gamma correction on the basis of information scanned by the color sensor, wherein the analysis-information forming unit forms the predetermined information on the sheet on the basis of a result of the determination by the timing determining unit.

8. An image forming apparatus according to claim 7, comprising:

an operation inputting unit configured to receive an operation input of a user;

an image scanning unit configured to be capable of scanning an image with an amount of information larger than that of the color sensor; and an image-quality control unit configured to perform, when image scanning of the sheet having the test pattern and the state information formed thereon performed by using the image scanning unit is instructed to the operation inputting unit, predetermined image quality control processing on the basis of information scanned by the image scanning unit.

9. An image forming apparatus comprising:

analysis-information forming means for forming predetermined information used for an analysis concerning the image forming apparatus on a sheet;

sheet conveying means for conveying the sheet having the predetermined information formed thereon by the analysis-information forming means to a predetermined position in the image forming apparatus through a second conveying path different from a first conveying path used in discharging a sheet having an image formed thereon to an outside of the image forming apparatus; and sheet storing means for storing the sheet conveyed to the predetermined position by the sheet conveying means, wherein the analysis-information forming means forms, on a sheet, together with a predetermined test pattern used for image quality control processing in the image forming apparatus, state information concerning a state of the image forming apparatus in forming the test pattern on the sheet.

10. An image forming apparatus according to claim 9, wherein the state information is at least one of temperature, humidity, and a counter value detected in the image forming apparatus.

11. An image forming apparatus according to claim 9, wherein the analysis-information forming means further forms, on a sheet on which the test pattern and the state information are formed, identification information for identifying the sheet, and the image forming apparatus further includes transmitting means for transmitting at least a part of the state information and the identification information formed on the sheet to a predetermined transmission destination.

12. An image forming apparatus according to claim 11, comprising a color sensor that is arranged further on a downstream side than a fixing device in a sheet conveying direction and scans the test pattern formed on the sheet, wherein the transmitting means transmits at least a part of information scanned by the color sensor to the predetermined transmission destination.

13. An image forming apparatus according to claim 9, wherein the predetermined position in the image forming apparatus is located in a place spaced apart from a sheet feeding cassette in which sheets, on which images are formed, are stored.

14. An image forming apparatus according to claim 9, wherein the sheet storing means is a sheet feeding cassette in which sheets, on which images are formed, are stored.

15. An image forming apparatus according to claim 9, comprising:

a color sensor that is located further on a downstream side than a fixing device in a sheet conveying direction and scans an image on a sheet conveyed; and timing determining means for determining timing of gamma correction on the basis of information scanned by the color sensor, wherein the analysis-information forming means forms the predetermined information on the sheet on the basis of a result of the determination by the timing determining means.

16. An image forming apparatus according to claim 15, comprising:

operation inputting means for receiving an operation input of a user;

image scanning means capable of scanning an image with an amount of information larger than that of the color sensor; and image-quality control means for performing, when image scanning of the sheet having the test pattern and the state information formed thereon performed by using the image scanning means is instructed to the operation inputting means, predetermined image quality control processing on the basis of information scanned by the image scanning means.

17. An analysis-information managing method comprising the steps of:

forming predetermined information used for an analysis concerning an image forming apparatus on a sheet;

conveying the sheet having the predetermined information formed thereon by the step of forming the predetermined information to a predetermined position in the image forming apparatus through a second conveying path different from a first conveying path used in discharging a sheet having an image formed thereon to an outside of the image forming apparatus; and storing the sheet conveyed to the predetermined position by the step of conveying the sheet, wherein forming predetermined information comprises forming, on a sheet, together with a predetermined test pattern used for image quality control processing in the image forming apparatus, state information concerning a state of the image forming apparatus in forming the test pattern on the sheet.

18. An image forming apparatus comprising:

an analysis-information forming unit configured to form predetermined information used for an analysis concerning the image forming apparatus on a sheet;

a sheet conveying unit configured to convey the sheet having the predetermined information formed thereon by the analysis-information forming unit, to a predetermined position in the image forming apparatus through a second conveying path different from a first conveying path used in discharging a sheet having an image formed thereon to an outside of the image forming apparatus; and a sheet storing unit configured to store the sheet conveyed to the predetermined position by the sheet conveying unit, wherein the analysis information forming unit further forms, on a sheet on which a test pattern and state information are formed, identification information for identifying the sheet, wherein the state information concerns a state of the image forming apparatus in forming the test pattern on the sheet.

19. An image forming apparatus that forms, on a sheet, a test pattern formed by a color obtained by mixing toners of plural colors, scans a test pattern image formed on the sheet with a color sensor, and performs predetermined image quality control processing on the basis of information scanned, the image forming apparatus comprising:

an analysis-information forming unit configured to form predetermined information used for an analysis concerning the image forming apparatus on a sheet;

a sheet conveying unit configured to convey the sheet having the predetermined information formed thereon by the analysis-information forming unit to a predetermined position in the image forming apparatus through a second conveying path different from a first conveying path used in discharging a sheet having an image formed thereon to an outside of the image forming apparatus;

a sheet storing unit configured to store the sheet conveyed to the predetermined position by the sheet conveying unit;

a color sensor that is arranged further on a downstream side than a fixing device in a sheet conveying direction and scans the test pattern formed on the sheet an operation inputting unit configured to receive an operation input of a user;

an image scanning unit configured to be capable of scanning an image with an amount of information larger than that of the color sensor; and an image-quality control unit configured to perform, when image scanning of the sheet having the test pattern and the state information formed thereon performed by using the image scanning unit is instructed to the operation inputting unit, predetermined image quality control processing on the basis of information scanned by the image scanning unit, wherein the state information concerns a state of the image forming apparatus in forming the test pattern on the sheet.

* * * * *